US005505011A

United States Patent [19]

Bleimhofer

[11] Patent Number: 5,505,011

[45] Date of Patent: Apr. 9, 1996

[54] WATERPROOF BREATHABLE FOOTWEAR WITH EXTENDED INSIDE LINER LAYER

[76] Inventor: Walter Bleimhofer, Stetten 11a, 8201 Ostermunchen, Germany

[21] Appl. No.: 277,057

[22] Filed: Jul. 19, 1994

Related U.S. Application Data

[63] Continuation of Ser. No. 981,112, Nov. 24, 1992, abandoned.

[51] Int. Cl.[6] ..... A43B 1/10; A43B 24/07; A43B 7/06

[52] U.S. Cl. ..... 36/4; 36/55; 36/3 A

[58] Field of Search ..... 36/4, 3 R, 3 A, 36/45, 12, 55, 9 R

[56] References Cited

U.S. PATENT DOCUMENTS

| | | | |
|---|---|---|---|
| 3,568,339 | 3/1971 | Hara et al. | 36/4 X |
| 4,292,746 | 10/1981 | Delaney | 36/45 X |
| 4,430,811 | 2/1984 | Okada | 36/45 |
| 4,508,582 | 4/1985 | Fink | 36/45 X |
| 4,532,316 | 7/1985 | Henn | 528/59 |
| 4,819,345 | 4/1989 | Mulcahy et al. | 36/17 R |
| 4,899,465 | 2/1990 | Bleimhofer et al. | 36/14 |

FOREIGN PATENT DOCUMENTS

| | | | |
|---|---|---|---|
| 2854464 | 7/1980 | Germany | 36/45 |
| 3821602 | 7/1987 | Germany . | |
| WO9006067 | 6/1990 | WIPO . | |

*Primary Examiner*—Paul T. Sewell
*Assistant Examiner*—Beth Anne C. Dayoan
*Attorney, Agent, or Firm*—Gary A. Samuels

[57] ABSTRACT

Waterproof, breathable footwear with an upper connected to an insole, the upper having an outside layer formed of an outer upper material and an inside layer constructed of a waterproof, water vapor-permeable functional layer and a liner material in which on the bottom end of the upper, the inside layer extends about 5 mm beyond the outside layer. Only the bottom end of inside layer is sewn to insole. The bottom end of outside layer is glued to the inside layer by an adhesive. An outsole is injection molded onto the insole, and the bottom ends of inside and outside layers.

11 Claims, 3 Drawing Sheets

WATERPROOF BREATHABLE FOOTWEAR WITH EXTENDED INSIDE LINER LAYER

This application is a continuation of application Ser. No. 07,981,112, filed Nov. 24, 1992, now abandoned.

FIELD OF THE INVENTION

The invention relates to waterproof, breathable footwear with a shoe upper whose bottom end is connected to an insole in which the upper has an outside upper formed with top material and an inside upper formed with liner material, and the liner material is provided with a waterproof, water vapor-permeable functional layer; the plastic outsole is injection molded onto the insole and the upper so that it encloses the bottom end of the outside upper and the inside upper.

BACKGROUND OF THE INVENTION

Waterproof, breathable footwear is made with air-permeable and water-permeable outer upper material such as leather and textile materials. Waterproofness with simultaneous water vapor permeability is achieved with the use of a liner laminate that has a waterproof water vapor-permeable functional layer which is provided with a backing fabric on the one side facing towards the outer upper material. On the other side of the functional layer, a lining material is also provided so that it is on the side away from the upper. The bottom end of the upper is sewn to an insole by means of a closing seam. A plastic or synthetic outsole is injected or injected molded onto the insole and the bottom end of the upper connected to it so that both the joining seam between the insole and end of the upper, as well as the end of the upper itself are enclosed by the plastic or synthetic of the outsole and thereby sealed.

The bottom ends of the outside upper and inside upper have thus far been sewn together and to the insole by means of a single seam. The underlying idea here is to position the seam in the region made waterproof by the outsole thus protecting it from water penetrating from without.

However, when water reaches the upper outer material in such shoes, moisture is found in the lining a short time later. The reason for this proved to be that the upper outer material used for such shoes, be it leather or a textile material, conducts water not only in its transverse direction, but also in its longitudinal direction. In this fashion, water that enters the upper material from the outside can travel through the upper material within the backing fabric or on the functional layer of the liner laminate to the bottom end of the upper lying within the outsole to reach the lining of the inside upper by means of two mechanisms. Water that has traveled in the upper material and in the backing fabric or on the functional layer to the seam joining the outside upper, the inside upper and the insole, reaches the liner material of the inside upper through the seam openings in the functional layer and the wick-like water-conducting seam threads. Also, in the manufacture of the inside upper it often happens that the textile threads of the textile reverse side and/or the liner material on the cutting edge of the bottom end of the inside upper extend around the cutting edge of the functional layer and act as water bridges from the upper material to the liner material.

Since the liner material ordinarily consists of a material with strong moisture absorption capacity, water that has reached the lining through this water bridging mechanism spreads very quickly in the lining. It takes at most only about 10 minutes for the liner material to become moist once water has come in contact with the outer upper material.

Although the water conductivity of the backing fabric has indeed been reduced by using monofilament textile materials, it cannot be completely eliminated.

A remedy for the aforementioned water bridging mechanism is described in U.S. Pat. No. 4,899,465. In this case, the outer material of the upper does not extend to the bottom end of the inside upper, but rather the bottom end of the outside upper is formed from a joining strip running within the outsole, the top end of which is sewn to the top of the outside upper and the bottom end of which is sewn by means of a closing seam to both the bottom end of the inside upper and to the insole. The joining strip consists of a material that is not water-conductive, and may be a spacer of net or mesh formed from a monofilament material. Water that reaches the top seam with the net within the outside upper cannot penetrate further to the bottom joining seam between the net, inside upper and insole. In addition, during injection molding of the outsole, the net is penetrated by liquid plastic which reaches the region of the backing fabric or the functional layer lying behind the net. In this fashion the backing fabric is glued together, its water conductivity is suppressed and the region of the functional layer within the injection molded outsole is sealed.

These measures proved to be very effective in suppressing water bridges between the outside upper and the lining. It is necessary to use a net with a width of at least 10 mm, thus ensuring a minimum inflow opening of about 5 mm for the liquid plastic of the outsole during the injection molding process. The remaining 5 mm is required for seam overhang to sew one end of the net to the outside upper and the other end to the inside upper and the insole. Since the seam between the net and the outside upper in the finished shoe must be covered by the injection molded outsole, this technique requires a minimum immersion depth of the upper in the injection molded outsole of 14mm. This leads to a corresponding minimum height of the outsole edge. For fashion reasons, shoes are also now desired with much thinner injection molded outsoles.

The net used for shoes of the aforementioned type ordinarily consists of a relatively rigid material. It is therefore difficult to fashion the net without causing an increased number of folds, especially in the region of the shoe tip and thus without a deterioration in fit of the shoe in the region of the insole. There is a need to improve the fit of the shoe and permit injection molding of a thinner outsole.

SUMMARY OF THE INVENTION

A waterproof, breathable footwear is provided having (a) an upper of which the bottom end is connected to an insole, and wherein the upper further comprises an outside layer formed from an outer upper material and an inside layer formed from a liner material which is provided with a waterproof, water vapor-permeable functional layer and (b) a plastic outsole which is injection molded onto an insole and upper such that it encloses the bottom end of the upper, outer and inner layer and wherein the bottom end of the inner layer of the upper protrudes from the bottom end of the outer layer of the upper toward the insole, further wherein the insole is only connected to the inside upper, and wherein the bottom end of the outer layer of the upper is glued to the inside layer of the upper and wherein the insole is injection molded directly onto the bottom end of the inside layer of the upper protruding from the bottom end of the outside layer of the upper. The invention further provides for sewing together the insole and inside layer of the upper and by gluing the outer layer of the upper to the inside layer by a polyurethane-based adhesive.

A process for manufacture is also provided.

DETAILED DESCRIPTION OF THE INVENTION

Figure 1:
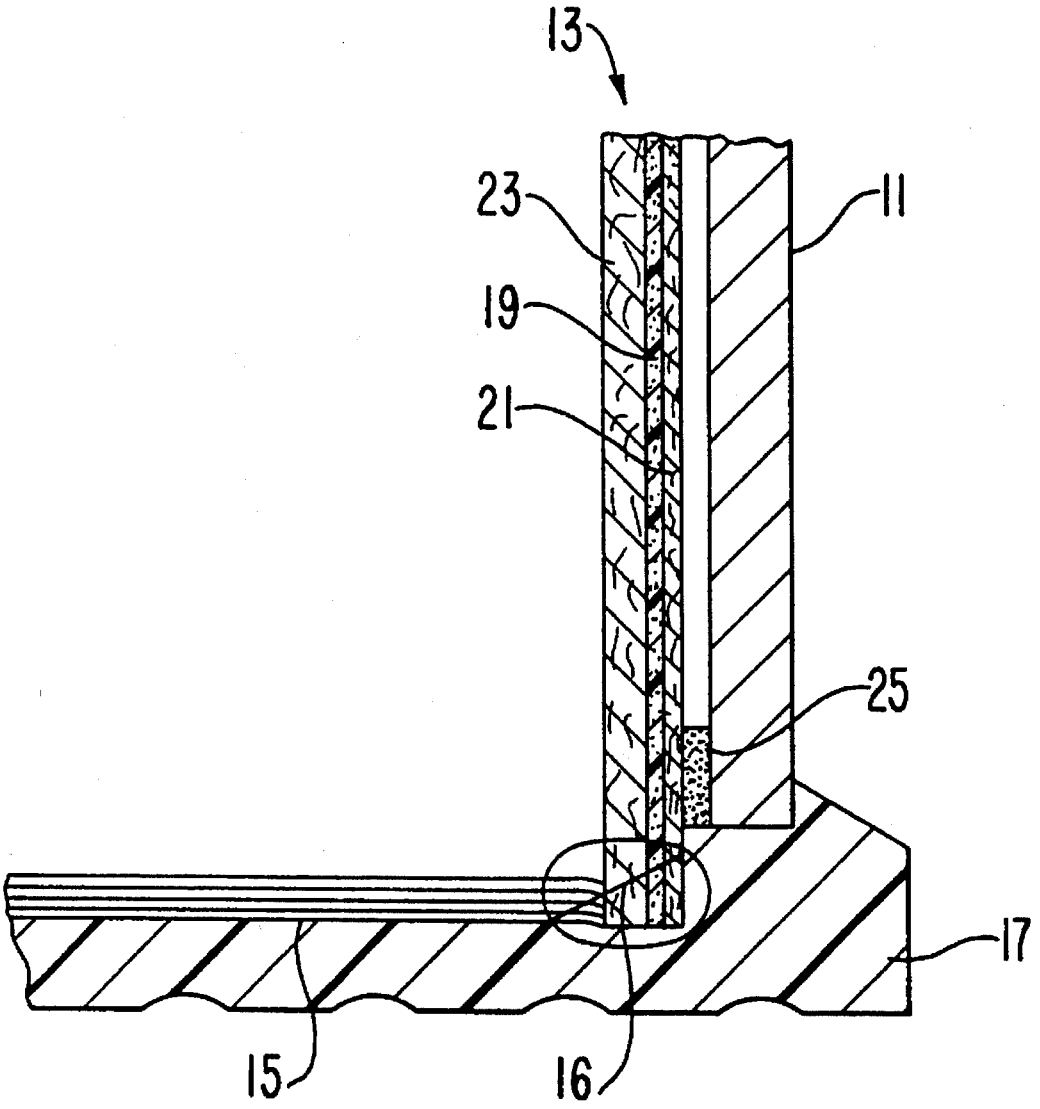
FIG. 1 shows a cutaway cross-sectional view of a first embodiment of the invention.

A footwear article is provided which has the bottom end of the inside layer of the upper extending from the bottom end of the outside layer of the upper such that the inside layer extends to the insole and wherein the insole is only connected to the inside layer of the upper and the bottom end of the outer layer of the upper is glued to the inside layer of the upper and further, wherein the outsole is directly injection molded onto the bottom end of the inside layer of the upper protruding from the bottom end of the outer layer of the upper. Conventional features of other shoes such as the net or mesh as described in the Background section, are eliminated and the sewn seam between the bottom end of the outer layer of the upper and the inside layer is replaced with a glued seam.

By these departures, water bridges from the outer layer of the upper to the liner material is avoided. In the design according to the invention, there is no sewn connection between the outside layer of the upper and the inside layer of the upper on the bottom end of the upper. Since the outer layer of the upper is shorter than the end of the inside layer of the upper and thus terminates at a distance from the end of the inside layer of the upper, during injection molding of the outsole, the liquid plastic material can still reach the inside layer of the upper unhampered, as through a net or mesh. This leads to more complete gluing together of the backing fabric and thus to an even more effective moisture barrier than in known footwear. Moisture that has reached the opposite backing fabric of the inside upper in a moistened outer upper material has even less of an opportunity to penetrate down the backing fabric to reach the liner material through the joining seam between the inside upper and insole. In the event that a backing fabric is present, this leads to complete sealing of that region of the functional layer that is situated within the injection molded outsole.

The inventive process allows for the minimum immersion depth of the upper in the injection molded outsole to be reduced to 4 mm with a corresponding reduction in the height of the outsole. In addition, this method leads to a significant cost saving compared to known footwear. First, the material costs for the net or mesh are saved. Also, double sewing of the net is avoided. Gluing of the bottom end of the outside layer of the upper to the inside layer of the upper is much less expensive than sewing of the bottom end of the upper to a net. In addition, the risk of damage to the functional layer of the inside upper is substantially reduced by gluing of the bottom end of the outside layer of the upper to the inside layer of the upper. Using the existing technology with the net, pressure peaks can occur at the seam between the outer upper material and the net. These peaks can occur during the injection molding of the outer sole, as well as during the walking movements produced while using the footwear and can lead to damage of the functional layer. Adhesive strips such as adhesive paste, used to glue the outside layer of the upper and inside layer of the upper, cover a wider area than a sewing seam, thus causing the occurrence of pressure points that act on joining seams and the attendant risk of damage to the functional layer to be avoided.

The bottom end of the outside layer of the upper is preferably about 5 mm shorter than the bottom end of the inside layer of the upper. The joint between the insole and inside layer of the upper is preferably achieved by sewing, especially by means of a closing seam (Strobel seam). A hot-melt adhesive based on polyurethane can be used as adhesive to glue the outside layer of the upper to the inside layer of the upper, preferably in the form of an adhesive paste.

The bottom end of both the outside layer of the upper and the inside layer of the upper can run essentially perpendicular to the outsole, in which case the bottom end of the inside layer of the upper protrudes downward over the bottom end of the outside layer of the upper and is sewn to it almost perpendicular to the insole.

The region of the inside layer of the upper that extends over the bottom end of the outside layer of the upper can also be bent at essentially a right angle from the bottom end of the outside layer of the upper toward the middle of the shoe. Here, the width of the insole is shortened corresponding to the bent length of the end of the inside layer of the upper and the bent region of the inside layer of the upper is sewn essentially coplanar to the insole. In this embodiment of the invention particularly thin injection molded outer soles can be achieved.

The invention can best be understood by reference to the accompanying drawings.

FIG. 1 schematically depicts a cross-section of the region of a shoe in which an outside layer of the upper 11, an inside layer of the upper 13, an insole 15 and a injection molded outsole 17 come in contact. The outside layer of the upper 11 consists of an outer upper material such as leather or a textile material. The inside layer of the upper 13 consists of a three-layered laminate with a functional layer 19 in the middle, a backing fabric 21 on the side facing the outside layer of the upper 11 and a liner material 23 on the side away from the outside layer of the upper 11. The functional layer 19 consists of a waterproof, water vapor-permeable material.

The inside layer of the upper can also consist of a two-layered laminate with a functional layer on the side facing the outside layer of the upper 11 and a liner material on the other side.

Materials suited for the functional layer include microporous, stretched polytetrafluoroethylene (PTFE), as described in U.S. Pat. Nos. 3,954,566 and 4,187,390; stretched PTFE provided with hydrophilic impregnation agents and/or layers, as described in U.S. Pat. No. 4,194,041; breathable polyurethane layers; or elastomers, like copolyether-esters and their laminates, as described in U.S. Pat. Nos. 4,725,481 and 4,493,870. The backing fabric may be constructed of a material knitted from synthetic fibers such as polyamide fibers.

The insole 15 and outsole 17 consist of conventional materials used in footwear, for example, leather, nonwoven fabric or polyurethane.

The bottom end of the inside layer of the upper 13 according to the invention is longer than the bottom end of the outside layer of the upper 11. A length difference of about 5 mm is preferred. The bottom end of both the inside layer of the upper 13 and the outside layer of the upper 11 run perpendicular to the outsole 17. The bottom end of the inside layer of the upper 13 is connected to the edge of the insole 15 via a closing seam 16. The bottom end of the outside layer of the upper 11 is connected to the inside layer of the upper 13 by means of an adhesive layer 25. The outsole 17 is injected molded to such a thickness that it encloses the bottom end of outside layer of the upper 11.

Figure 2:
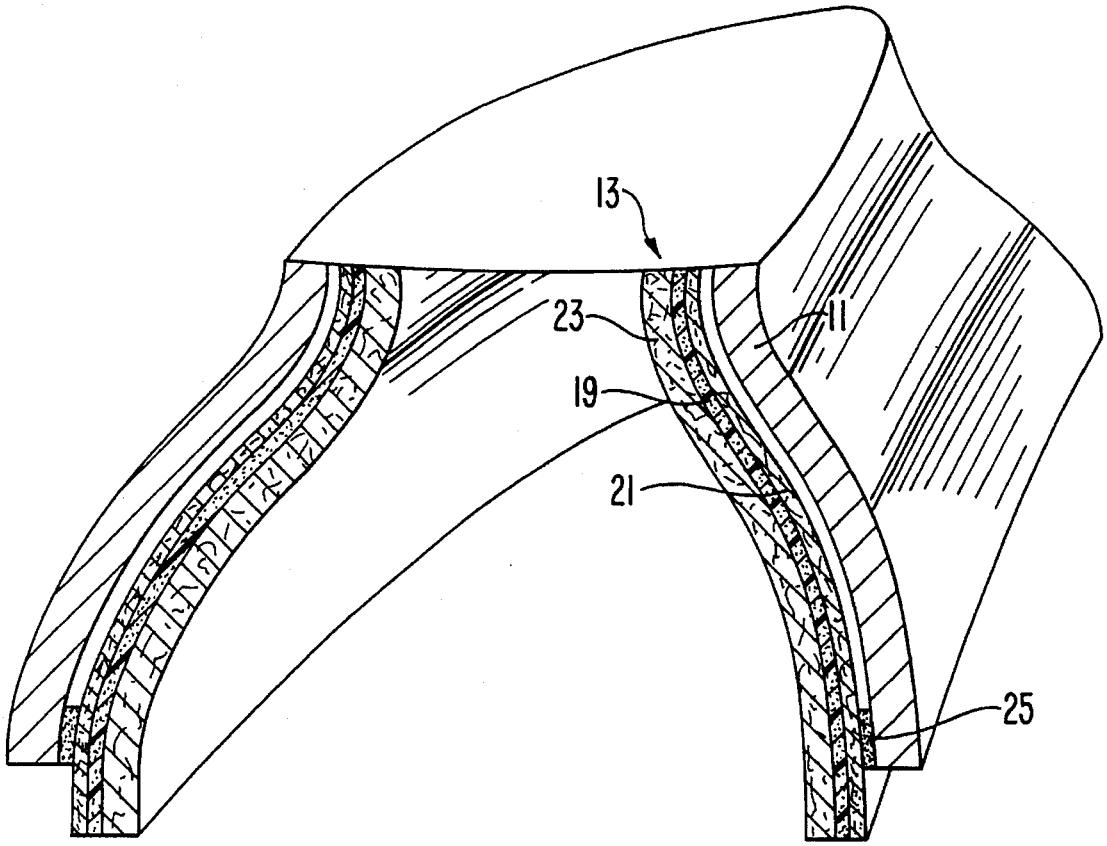
FIG. 2 shows an intermediate stage in the manufacture of the footwear in accordance with the invention.

To manufacture footwear according to FIG. 1, the outside layer of the upper 11 and the inside layer of the upper 13 are produced first in such a way that the inside layer 13 on its bottom end is about 5 mm longer than the outside layer 11. The outside layer 11 and the inside layer 13 are then sewn together at their top ends, forming a foot insertion opening. Thereupon as desired, the bottom end of the inside layer 13 protrudes 5 mm further than the bottom end of the outside layer 11. A hot-melt adhesive, preferably in the form of an adhesive paste or bead 2 to 3 mm wide is then applied on the inside edge of the bottom end of the outside layer 11 or alternatively at a distance of 5 mm from the bottom end of the inside layer on the outer side of the inside layer 13. Depending on the adhesive employed, a short time thereafter pressing of the bottom end of outside layer 11 onto inside layer 13 occurs, if an adhesive that is capable of adhesion immediately after application is used. However, gluing can also occur at any later time, if an adhesive is used that must be first achieved, such as by heat to become capable of adhesion. Following this manufacturing step, a composite construction is created with outside layer 11 and inside layer 13 of the upper, as schematically shown in FIG. 2.

After gluing of outside layer 11 and inside layer 13, the insole is sewn to the end of the inside layer 13 protruding downward over outside layer 11. For this purpose a closing seam or a stitching seam is preferably used. The composite outside layer 11, inside layer 13 and insole 15 is then stretched on a last and the outsole 17 is then injection molded on.

Figure 3:
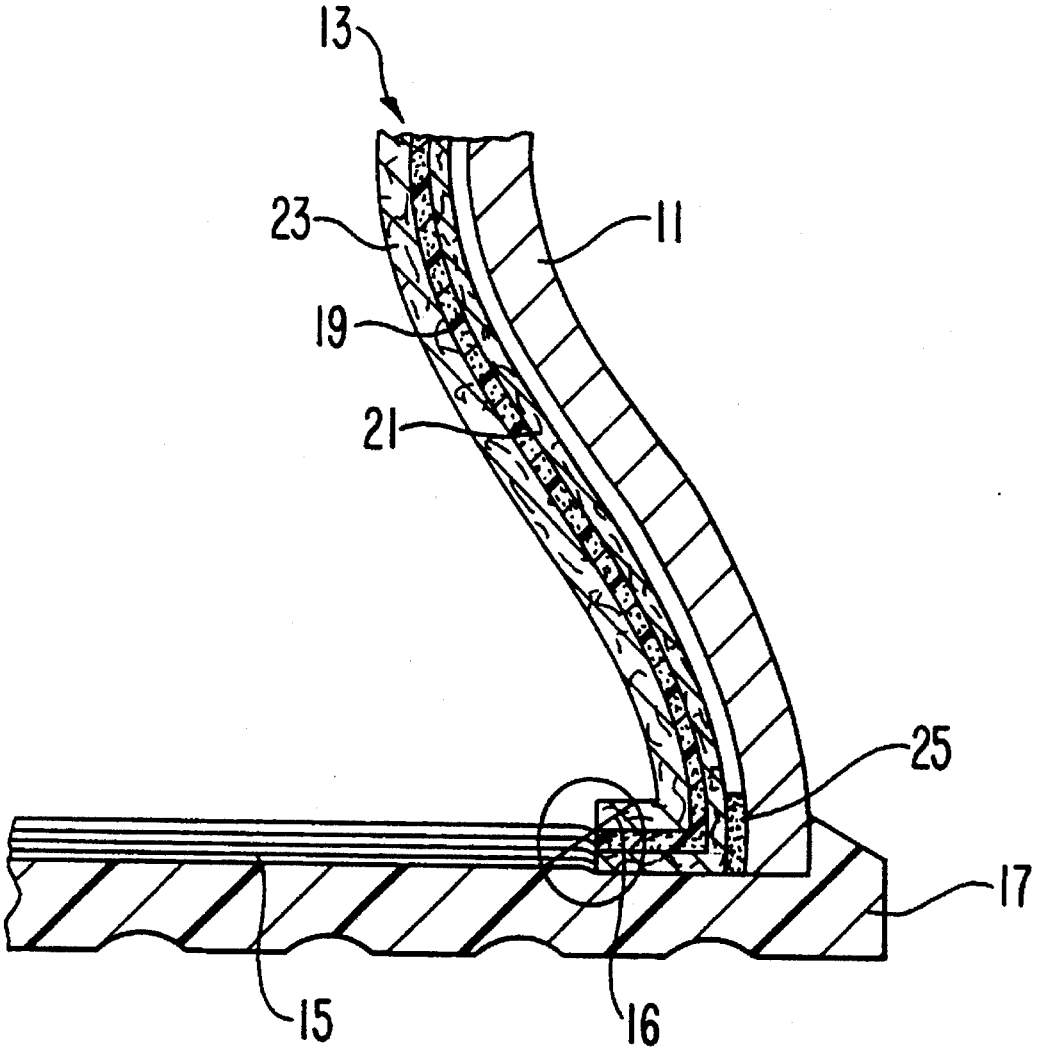
FIG. 3 shows a cutaway cross-sectional view of a second embodiment of the invention.

FIG. 3, for which the same numbers as in FIG. 1 were used, shows a cutaway cross-sectional view of a second version of the invention that differs from the first version depicted in FIG. 1 with respect to the direction of the bottom end of the inside layer that extends over the bottom end of the outside layer. In this case this bottom end of the inside layer is bent back at almost a right angle from the bottom end of the outside layer in a direction toward the middle of the shoe with the edge of the insole being set back by a length corresponding to the bent over bottom end toward the middle of the shoe. The bent bottom end of the inside layer in this version is sewn to the edge of insole 15 in essentially the same plane as insole 15. In this version the height of the outsole 17 can be made smaller than in the first version according to FIG. 1 by the amount by which the bottom edge of the outside layer in the first version lies higher than insole 15.

The manufacturing process is the same as for the first version to produce the second version, the only departure being that a smaller insole 15 is cut out, that the end of the inside layer protruding downward over the bottom end of the outside layer is sewn to the edge of the insole in the state bent away from the bottom end of the outside layer and that a lower injection mold is used for the outsole.

When a closing seam is involved, the edge of the insole and the end of the inside upper are sewn together in a roughly V-shape as shown in FIGS. 1 and 3 in which the insole 15 is bent at the end forming a "V" when it meets with the inside layer 13 of the upper.

I claim:

1. A waterproof breathable footwear comprising:

(a) an upper having an outside layer formed of an outer upper material and an inside layer formed of a liner material in which the liner material is provided with a waterproof, water vapor-permeable functional layer, said layers having bottom ends;

(b) an insole to which the bottom end of the inside layer of the upper is connected; and (c) an injection molded plastic outsole attached to the insole and upper in such a way that it encloses the bottom ends of the outside layer and inside layer, wherein the bottom end of the inside layer extends beyond the bottom end of the outside layer wherein the insole is only connected to the inside layer and the bottom end of the outside layer is glued by a layer of adhesive to the inside layer, and wherein the outsole is injection molded directly onto the bottom ends of the extended inside layer and outer layer.

2. A footwear article according to claim 1, wherein the insole and the inside layer are connected by a sewn seam.

3. A footwear article according to claim 2, wherein the insole and inside layer are connected by means of a closing seam.

4. A footwear according to claim 1, wherein the bottom end of the inside layer protrudes about 5 mm from the bottom end of the outside layer.

5. A footwear according to claim 1, wherein a polyurethane-based adhesive layer is between the outside layer and inside layer so as to glue them together.

6. A footwear according to claim 1, wherein the bottom end of the outside layer is in a direction perpendicular to a direction of the outsole and the bottom end of the inside layer is in a direction parallel to that of the bottom end of the outside layer.

7. A footwear according to claim 1, wherein the bottom end of the outside layer is in a direction perpendicular to a direction of the outsole, the edge of the insole is set back from the bottom ends of the outside layer and inside layer of the upper toward the middle of the footwear and wherein a region of the bottom end of the inside layer extending beyond the bottom end of the outside layer is bent toward the edge of the insole.

8. A footwear according to claim 7, wherein the bottom end of the outside layer ends essentially in the plane of the bottom side of the insole.

9. A process for manufacture of waterproof breathable footwear with an outsole comprising (a) forming an outer upper with an outside layer and an inside layer having a liner material and a waterproof, water vapor-permeable functional layer, in which the inside layer has a bottom end longer than the outside layer bottom end; (b) connecting the outside layer and inside layer at top end; (c) forming a foot insertion opening in such a way that the bottom end of the inside layer extends beyond the bottom end of the outside layer; (d) applying an adhesive layer to the bottom end of the outside layer on a side facing the inside layer and to a side of the inside facing the outside layer at a height corresponding to the bottom end of the outside layer and gluing the outside layer and the inside layer together; (e) connecting the insole to the bottom end of the inside layer; and (f) injection molding an outsole onto the insole and the bottom end of the outside layer and inside layer such that the bottom ends of the outside and inside layers are enclosed by the outsole such that the outsole is injection molded directly onto the bottom end of the extended inside layer.

10. A process according to claim 9, further comprising using an adhesive that is capable of adhesion immediately after application.

11. A process according to claim 9, further comprising applying an adhesive that is made capable of adhesion by heat activation.

* * * * *